United States Patent [19]

Gray et al.

[11] 3,998,448

[45] Dec. 21, 1976

[54] CONTINUOUS STACK ADVANCER FOR BLANK DESTACKING

[75] Inventors: Archibald C. Gray, Delaware; Douglas I. Van Aernum, Columbus, both of Ohio

[73] Assignee: C. I. Industries, Inc., Delaware, Ohio

[22] Filed: Oct. 31, 1974

[21] Appl. No.: 519,399

[52] U.S. Cl. ..... 271/12; 198/422; 214/8.5 A; 214/8.5 D; 271/18.1; 271/30 R; 271/159; 271/263

[51] Int. Cl.[2] ..... B65H 1/30; B65H 3/08; B65H 3/60

[58] Field of Search ..... 271/3.1, 159, 158, 18.1, 271/64, 263, 262, 193, 152–156, 10–13, 212, 30, 31; 214/6 BA, 8.5 A, 8.5 D; 198/41, 35

[56] References Cited

UNITED STATES PATENTS

| | | | |
|---|---|---|---|
| 2,298,368 | 10/1942 | Goebel et al. | 271/262 X |
| 2,654,603 | 10/1953 | Williams et al. | 271/159 |
| 2,900,186 | 8/1959 | Schwebel | 271/158 |
| 2,968,481 | 1/1961 | Taylor | 271/159 |
| 3,038,615 | 6/1962 | Roth et al. | 214/8.5 A |
| 3,512,660 | 5/1970 | Bende | 214/8.5 D |

*Primary Examiner*—Evon C. Blunk
*Assistant Examiner*—Bruce H. Stoner, Jr.
*Attorney, Agent, or Firm*—Donnelly, Maky, Renner & Otto

[57] ABSTRACT

Two vertically aligned elevators, each being adapted to support a stack of blanks, elevate the blanks to a magnetic blank separator and conveyor. A releasable stack support on the upper of the elevators is operative to release the stack held thereby when the stack on the lower elevator is elevated subjacent the stack of the upper elevator, with the lower elevator then supporting the merged stack of both elevators. The stack support on the upper elevator engages beneath the merged stack at a predetermined height of the lower of said elevators to permit the latter to return for another stack. A stack height sensing device automatically alternately controls the vertical movement of the elevators when supporting the merged stack for continuous upward movement of the same for separation and lift-off. A double thickness detector is provided in combination with an ejector to ensure the conveying of only one blank at a time from the top of the stack.

22 Claims, 22 Drawing Figures

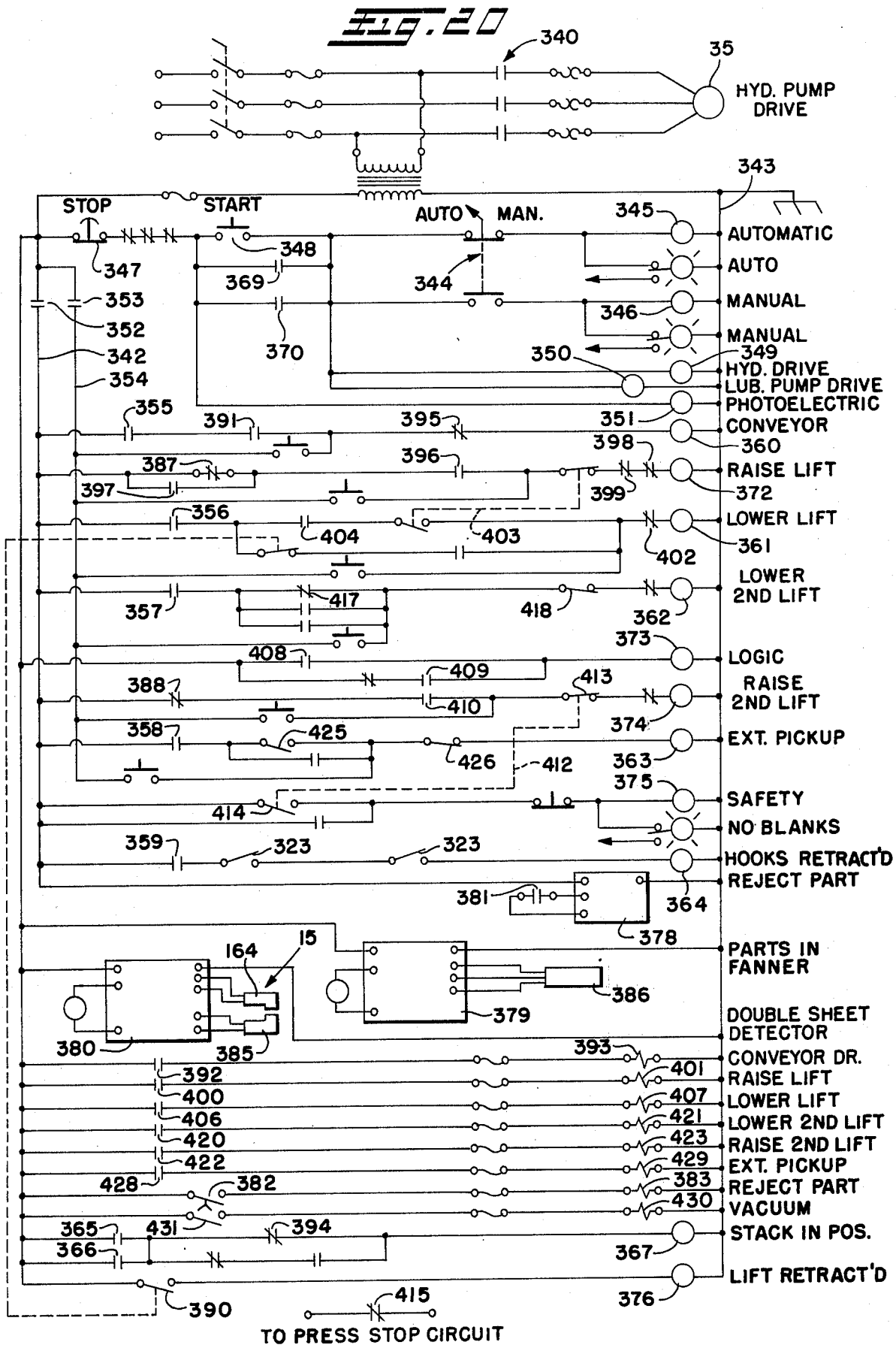
Fig. 20
340
35
HYD. PUMP DRIVE
343
STOP
START
AUTO
MAN.
345
AUTOMATIC
348
347
AUTO
369
344
353
MANUAL
352
346
MANUAL
342
370
350
349
HYD. DRIVE
354
LUB. PUMP DRIVE
355
PHOTOELECTRIC
391
395
351
CONVEYOR
398
360
387
396
RAISE LIFT
397
399
372
356
LOWER LIFT
404
403
402
361
LOWER 2ND LIFT
357
417
418
362
373
LOGIC
408
409
388
413
RAISE 2ND LIFT
410
374
358
425
EXT. PICKUP
426
412
363
375
SAFETY
414
NO BLANKS
359
323
323
HOOKS RETRACT'D
REJECT PART
381
364
378
15
164
PARTS IN FANNER
386
379
DOUBLE SHEET DETECTOR
380
385
393
CONVEYOR DR.
392
401
RAISE LIFT
400
407
LOWER LIFT
406
421
LOWER 2ND LIFT
420
423
RAISE 2ND LIFT
422
429
EXT. PICKUP
428
382
383
REJECT PART
430
VACUUM
365
431
394
STACK IN POS.
366
367
LIFT RETRACT'D
390
376
415
TO PRESS STOP CIRCUIT

CONTINUOUS STACK ADVANCER FOR BLANK DESTACKING

This invention relates as indicated to a destacker method and apparatus and more particularly to a method and apparatus for feeding blanks from the top of a stack one-at-a-time to a conveyor, press or other blank working or assembling operation.

Destackers have been provided for feeding or dealing blanks from the top of a stack, but when the stack is exhausted, the destacker is temporarily down while the stack is replenished. where the blank is being fed to high cost, high production forming or stamping presses, which usually incorporate their own automatic feeders, the periodic interruptions can be annoying and costly. In automatic conveying lines, an interruption requires expensive compensating devices or delays downstream. Any delay, of course, adversely affects productivity.

Accordingly, it is desirable to provide a destacker which can function continuously.

Moreover, when feeding parts to a forming or stamping press, it may be essential that only one part at a time be placed in the dies. If a double thickness part is placed in the dies, severe damage may result to the dies and the press. Such equipment is very costly to repair or replace.

Accordingly, it is also desirable to provide a destacker which will ensure that only one blank at a time is dealt from the top of the stack.

For shipment, transfer, and packaging, blanks are often palletized and the pallet then becomes an integral part of the stack. It is therefore important that a destacker of the type disclosed herein be able to form a continuously upwardly moving stack from stack increments which incorporate a pallet. The pallet, of course, cannot form a portion of the continuously upwardly moving stack and therefore must be ejected or otherwise disposed of.

It is therefore desirable to provide a destacker which can form a continuously upwardly moving stack from stack increments which are palletized.

A principal object of the present invention is the provision of a destacker which can function continuously.

Another principal object is the provision of a destacker utilizing two elevators vertically aligned which can form a continuously upwardly moving stack from stack increments.

Another important object is the provision of a destacker having a double thickness part detector which will eject the double thickness part from the parts conveyed one-at-a-time from the top of the stack.

Yet another important object is the provision of a destacker which can form a continuously upwardly moving stack from stack increments which are palletized.

A further object is the provision of a destacker utilizing two aligned stack elevators, the upward feed movement of which is controlled alternately by a stack height sensing device.

Another object is the provision of such destacker wherein the upper elevator is provided with a stack support means operative to release the stack held thereby when the stack on the lower elevator is elevated subjacent the stack of the upper elevator, with the movement of the stack then being controlled by the lower elevator through the stack height sensing device.

Still another object is the provision of a destacker incorporating an elevator utilizing cam operated stack support means which is unlatched and then cammed clear of the stack by a stack approaching the support means from the bottom.

Other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

In said annexed drawings:

FIG. 4 is an enlarged fragmentary side elevation of the infeed conveyor and primary elevator adjacent the exit end thereof;

FIG. 19 is a schematic flow diagram showing the movement of the blank stack increments onto the primary elevator for elevation and merging with the stack of the secondary elevator to be fanned apart, lifted one-at-a-time from the stack, and horizontally conveyed;

FIG. 20 is a schematic electrical diagram showing the electrical components and the sequence of operation of the present invention;

MACHINE — GENERAL ASSEMBLY, FIGS. 1–3

Figures 1, 2:
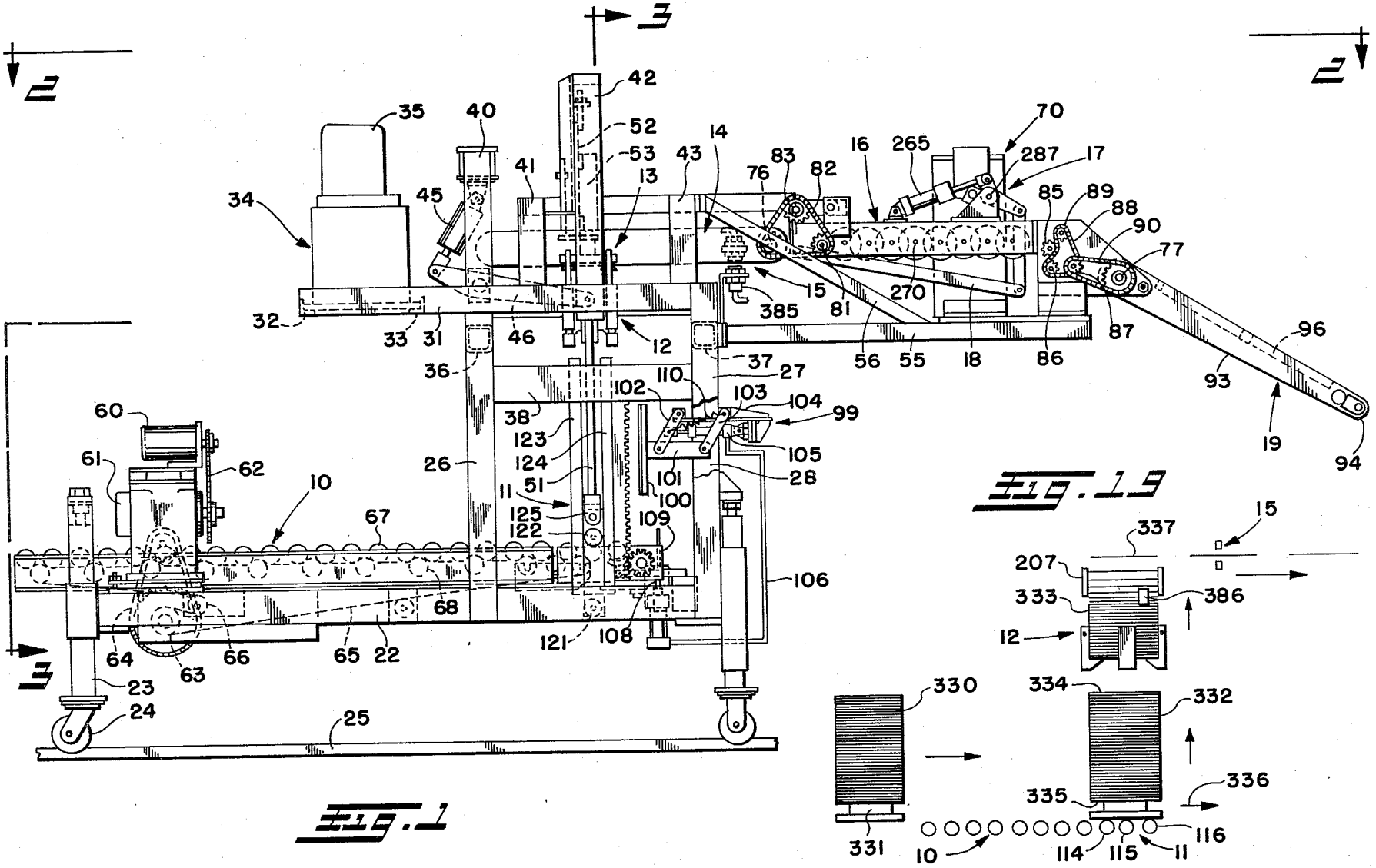
FIG. 1 is a general assembly side elevation partially broken away of a destacker in accordance with the present invention.
FIG. 2 is a top plan view of the destacker as seen from line 2—2 of FIG. 1.
Figure 2:
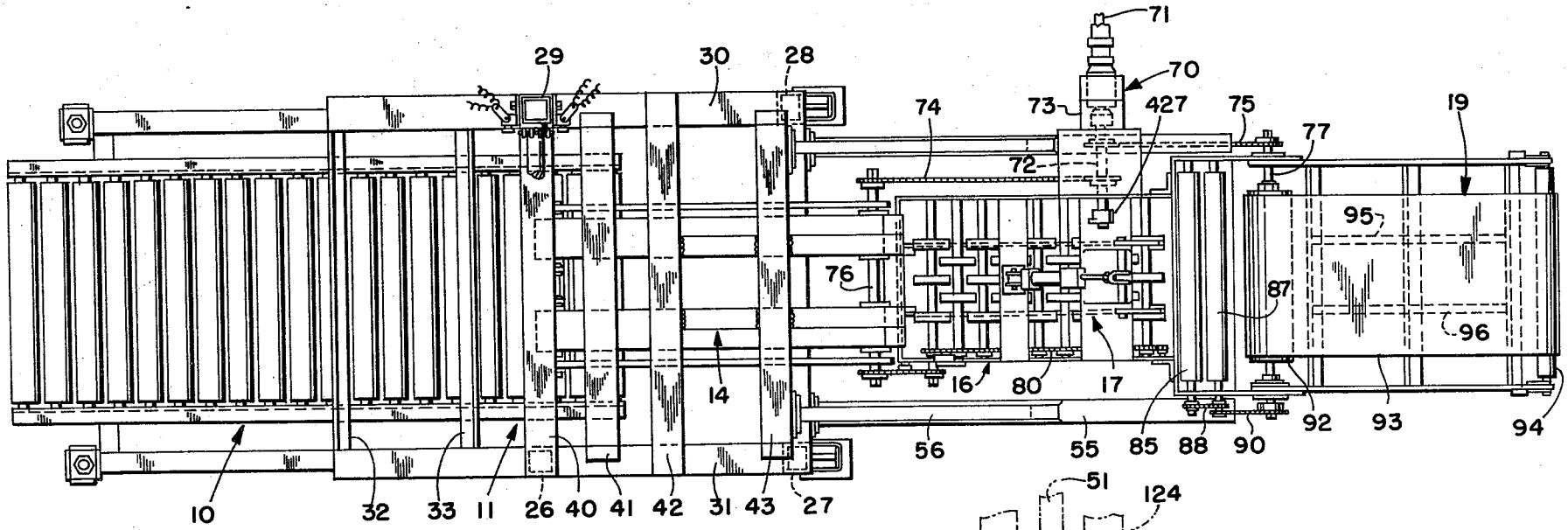
Figure 3:
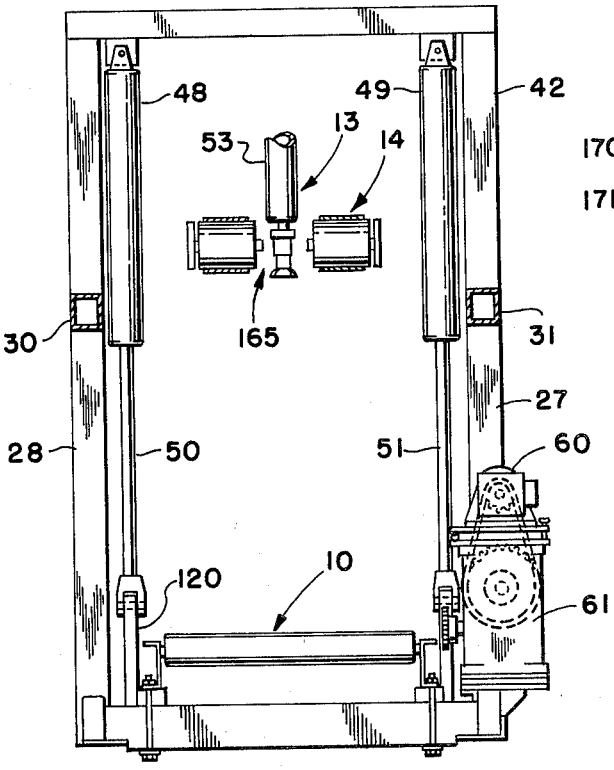
FIG. 3 is an end elevation partially in section of the destacker as seen from line 3—3 of FIG. 1.

Referring now to FIGS. 1–3, it will be seen that the destacker of the present invention comprises a horizontally extending infeed conveyor 10 adapted to move stack increments of blanks horizontally onto primary elevator 11 which is vertically aligned with secondary elevator 12. The stack of blanks is transferred from the primary elevator 11 to the secondary elevator 12 and move upwardly through fanner magnets, in the case of magnetic blanks, to be vertically separated and lifted from the top of the stack by vacuum pickoff 13. The parts are then placed on the underside of magnetic liftoff conveyor 14 to be conveyed horizontally or laterally one-at-a-time from the top of the stack. The blanks move through a double thickness detector indicated at 15 and along the underside of ejector magnetic roller conveyor 16 which includes a double thickness ejector 17 operative when energized to extend ejector bars 18 downwardly to remove the double thickness blank from the underside of the conveyor 16. From the conveyor 16, the parts pass onto the top of magnetic outfeed conveyor 19, the discharge angle of which may be varied. From the conveyor 19, the parts pass on-at-a-time to a subsequent conveyor, such as a furnace or coating conveyor, or a feed or transfer device of a stamping or blank working press, for example.

In order cooperatively to support the various subasemblies thus described, the machine includes a frame fabricated by welding of various structural members, principally of tubular members of square sectional shape. Briefly, the frame includes a horizontal rectangular portion 22, at the four corners of which are adjustable posts 23 having casters 24 on the lower ends thereof. Such casters may be of the V type riding on rails 25 so that the entire machine is movable therealong to and from and operative or in line position. The frame also includes four vertically extending main posts 26, 27, 28 and 29 which enclose and indirectly support the aligned primary and secondary elevators 12 and 13. On top of the posts 26 and 29 are two horizontal frame members 30 and 31 which are secured at one end adjacent the tops of posts 27 and 28 and extend at the other end in cantilever fashion from the posts 26 and 29. Such frame members are interconnected by angle frame members 32 and 33, which frame members support hydraulic power unit 34. The power unit 34 includes a pump motor 35, the pump, sump, and additionally supports the main hydraulic control valves, which are hereinafter shown in greater detail schematically. In addition, the frame members 32 and 33 may also support the electrical control panels of the machine.

The posts 26 through 29 are interconnected by transverse frame members 36 and 37 and longitudinally extending frame plates 38, one plate member 38 being provided on each side of the machine.

In addition, the top of the machine is provided with several inverted U-shape frames as seen at 40, 41, 42, and 43 in FIG. 1. The horizontal portion of the frame 40 supports the blind end of hydraulic piston-cylinder assembly 45 actuating the secondary lift through levers 46. The frame 42 supports the blind ends of hydraulic piston-cylinder assemblies 48 and 49, the rods 50 and 51, of which, are connected to the primary elevator 11. In addition, the frame 42 has secured thereto a mounting plate 52 supporting vertically extending pneumatic piston-cylinder assembly 53, the rod of which actuates the vacuum liftoff 13.

Frames 41 and 43 adjustably support magnetic liftoff conveyor 14. The exit end of ejector conveyor 16 and the proximal end of the pivotally mounted outfeed conveyor 19 are supported on horizontally extending U-shape frame 55 which extends in cantilever fashion from the posts 27 and 29. Inclined frame members 56 on each side extend from the frame member 55 to the top of the U-shape frame 43 to assist in supporting frame 55 horizontally.

The drive for the infeed conveyor is obtained by a hydraulic motor 60 driving speed reducer 61 through the chain drive 62. The speed reducer in turn drives belt pulley 63 through chain drive 64. The belt 65 wrapped around the drive pulley 63 and idler 66 is held against each of the conveyor rolls 67 by idler pressure rolls 68 positioned beneath and between every other conveyor roll 67. Accordingly, counter-clockwise movement of the belt drive pully 63 as seen in FIG. 1 will impart clockwise uniform rotation to each of the conveyor rolls 67. The details of such drive are shown more clearly in FIG. 4.

The drive for the liftoff conveyor 14, the ejector conveyor 16 and the outfeed conveyor 19 is provided from a power takeoff shown generally at 70 and such takeoff may comprise a flexible drive shaft 71 connected to a downstream piece of equipment such as the power press to which the blanks are being fed. The flexible shaft is connected to sprocket shaft 72 through coupler 73. Chain drives 74 and 75 connect the sprocket shaft to the head shaft 76 of the liftoff conveyor 14 and drive shaft 77 of outfeed conveyor 19, respectively. The ejector conveyor 16 is driven by a chain drive 80 interconnecting the various roller shafts which is in turn driven from head shaft 81 driven by chain drive 82 interconnecting the shafts 81 and 76 about idler sprocket 83.

Between the ejector conveyor 16 and the outfeed conveyor 19, there is provided a cluster of three rolls 85, 86 and 87 which are interconnected by chain drive 88 extending about idler sprocket 89. Such rolls are driven for rotation by chain drive 90 extending between the shaft of roll 87 and the shaft 77. With the drive shown, clockwise movement of the shaft 77 will thus cause the rolls 86 and 87 also to move in a clockwise direction and the roll 85 to move in a counterclockwise direction, as viewed in FIG. 1. Accordingly, the power takeoff 70 will cause the drive shaft 76 of the liftoff conveyor to rotate in a counterclockwise direction as seen in FIG. 1 and the interconnecting chain drive 82 will also cause each of the rollers of the ejector conveyor also to move in a counterclockwise direction. Such power takeoff also rotates the roll 85 in a counterclockwise direction and the rolls 86 and 87 in a clockwise direction together with the shaft 77 of the outfeed conveyor 19. The outfeed conveyor includes a drive pulley 92 for belt 93 and an idler pulley 94 at the distal end thereof. Bar magnets indicated at 95 and 96 underly the top flight of the belt to maintain positive control of the blank during lateral or horizontal conveying. The angle of inclination of the outfeed conveyor 19 may be adjusted to deposit the blanks conveyed on the top surface thereof at a desired location.

The hydraulic drive of the infeed conveyor 19 is adjustable and is normally at a relatively low speed so that the stack of blanks moving horizontally therealong will not fall over when the same stops on the primary elevator 11. However, if stack fallover on stopping on the primary elevator 11 is a problem, a stack stop indicated at 99 may be provided. Such stack stop comprises a pair of vertically extending stop bars 100 mounted on horizontal stop plate 101 supported by parallel links 102 and 103 from bracket 104 mounted between the posts 27 and 28. Hydraulic piston-cylinder assembly 105 has its blind end mounted on the bracket and its rod end pivotally connected to the linkage 102. A high pressure hydraulic line 106 connects the blind end of the piston-cylinder assembly 105 with the blind end of master piston-cylinder assembly 107 which is adjustably vertically mounted on frame 22. The rod 108 of the master piston-cylinder assembly comprises an upwardly extending plunger operative to be engaged by side plate 109 of the primary elevator 11 in its lowermost position. Accordingly, when the primary elevator descends it depresses the plunger 108 causing hydraulic fluid to move through the line 106 extending the piston-cylinder assembly 105 against the pressure of tension spring 110. This causes the stop bars 100 to move to the left as seen in FIG. 1 bringing the same into position to engage the stack as it stops on the primary elevator preventing the stack from falling over. As the primary elevator ascends, the plunger 108 is permitted to extend with the tension spring 110 retracting the piston-cylinder 105 and extending the plunger 108. In the retracted position of the stack stop, the stop bars 100 are clear of the squaring shaft 111 on the primary elevator. Depending upon the speed of the infeed elevator and the height and type of stack increments employed, the stack stop may be omitted.

INFEED CONVEYOR & PRIMARY ELEVATOR — FIG. 4

Referring now additionally to FIG. 4, it will be seen that the primary elevator comprises two side plates 109 between which are journalled rollers 114, 115 and 116. Such rollers in the lowermost position of the primary elevator are horizontally aligned with the rollers 67 of the infeed conveyor and such rollers are the same axial length. On the outside of each primary elevator side plate is a lift bar adaptor 117 secured to the side plate by the fasteners at 118 and to each adapter there is secured by fasteners 119 a lift bar 120. Each lift bar is provided with two vertically spaced outwardly extending rollers seen at 121 and 122 which ride between fixed tracks 123 and 124 on each side of the machine. Such tracks are secured at their lower end to the frame 22 and at their upper end to the tranverse frame members 38. The upper end of each lift bar is connected through clevis 125 to the respective rods 50 and 51 of the primary elevator piston-cylinder assemblies 48 and 49, respecitvly.

Squaring shaft 111 which is journalled in and extends between the side plates 109 is provided on each end with a pinion 126, each of which is in mesh with a rack 127 secured to track 124. Such rack and pinion squaring mechanism ensures that the rods 50 and 51 of the piston-cylinder assemblies 48 and 49 will operate in unison maintaining the three roller platforms of the primary elevator horizontal at all times.

In the lowermost position of the primary elevator, the rollers 114 and 115 will rotate at the same speed as the infeed conveyor rollers 67, both being driven by the belt 65. The roll 116 in the lowermost position of the elevator will idle. Drive of the rollers 114 and 115 is obtained by the wrapping of belt 65 around rollers 130 and 131 which are journalled on infeed conveyor extension 132. Thus in the lowermost position of the elevator, the rolls 114 and 116 will contact the belt at the points 133 and 134, respectively, to be driven thereby. Clearance is provided between the roller 131 and the roller 114 as well as the ajacent roller 67.

Although the roller 116 idles in the lowermost position of the elevator, a brake shoe 135 mounted on one end of pivotally mounted arm 136 will engage such roller as the elevator moves upwardly due to counterweight 137 moving away from fixed stop 138. The counterweight is, of course, mounted on the opposite end of the arm 136 and will function to lift the brake shoe against the roller as the counterweight descends. When the elevator reaches its lowermost position, the fixed stop 138 elevates the counter-weight pivoting the arm 136 to cause the brake shoe 135 to move away from the roller 116 permitting the same to idle. With the brake shoe against the roller during the elevation of the elevator, the stack cannot roll off the elevator platform.

There is also shown a stack position sensor 140 operative to trip switch 141 to cause the infeed conveyor to stop when the stack moving to the right therealong as seen in FIG. 4 has achieved the proper position on the elevator. The stack position sensor may comprise either a limit switch, as shown, or a photoelectric device.

LIFTOFF CONVEYOR — FIGS. 5, 6, & 7

Figure 5:
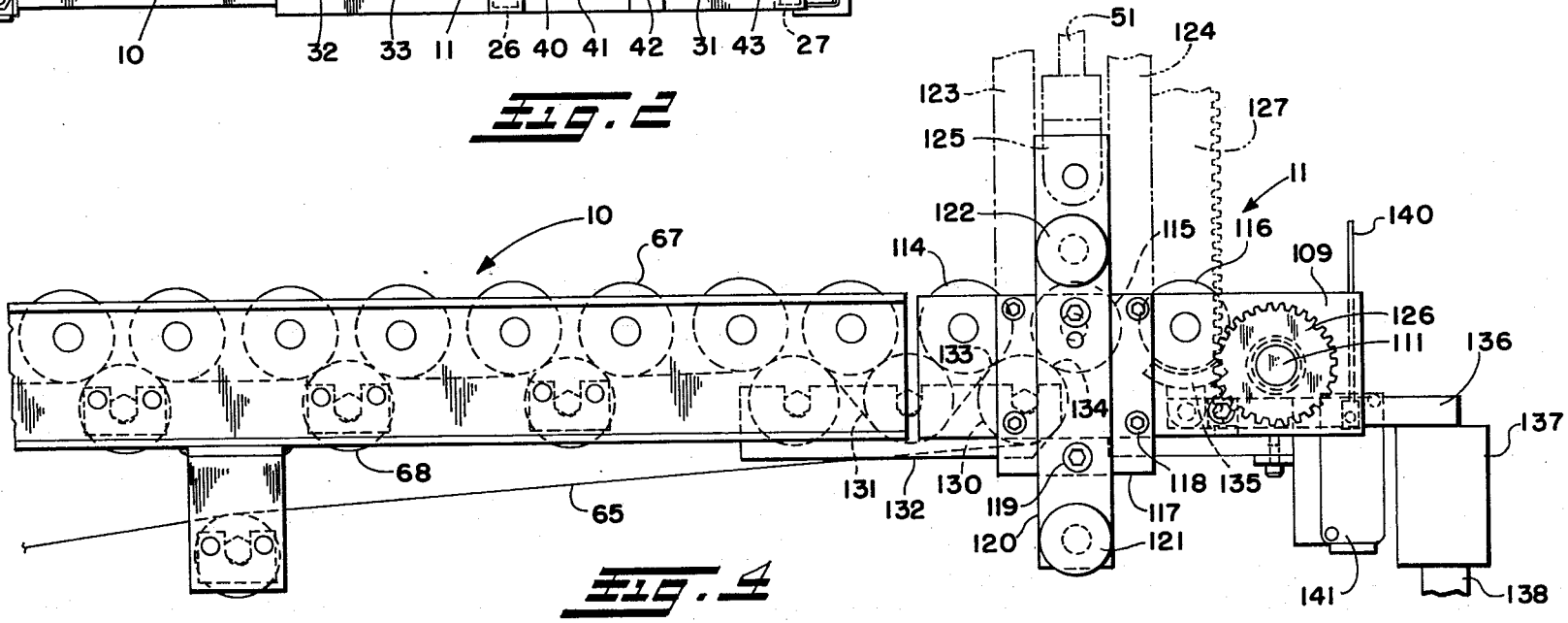
FIG. 5 is an enlarged side elevation partially broken away of the magnetic liftoff conveyor.
Figure 6:
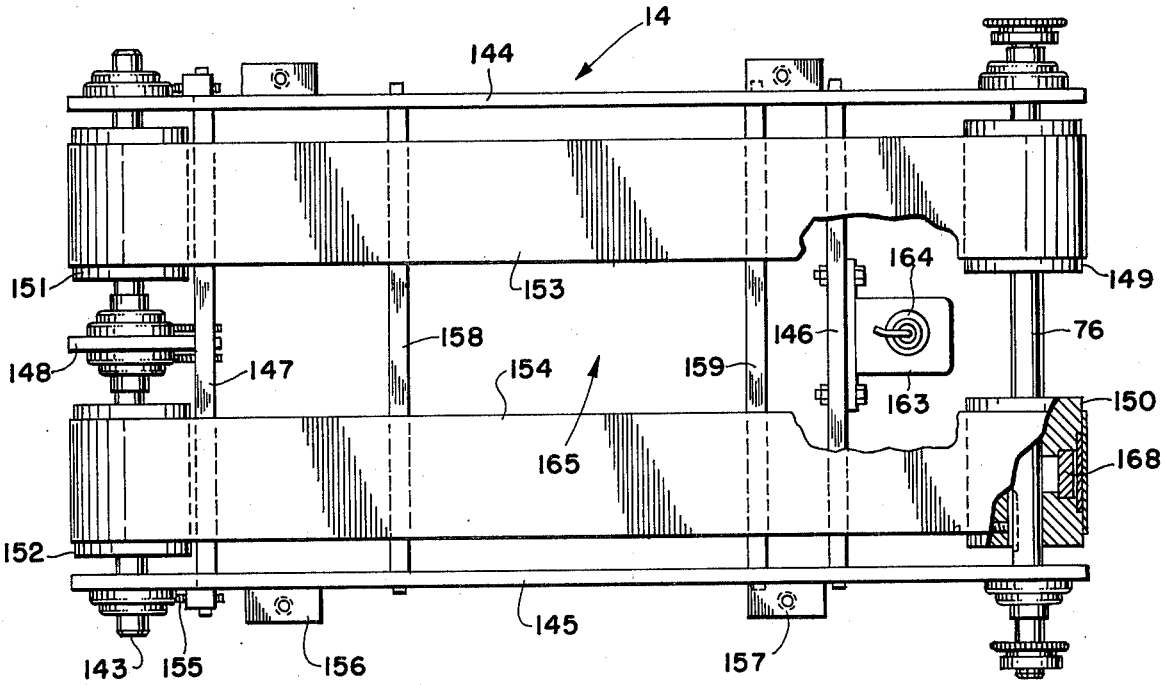
FIG. 6 is a top plan view, partially broken away, of such liftoff conveyor as seen from line 6—6 of FIG. 5.

With reference initially to FIGS. 5 and 6, it will be seen that the liftoff conveyor 14 comprises the driven head shaft 76 and a tail shaft 143, both being journalled in side plates 144 and 145. The side plates are interconnected by a head crossbar 146 and a tail crossbar 147 with the latter including a center tail shaft support 148, in which the tail shaft is also journalled.

The head shaft is provided with two laterally spaced magnetic belt pulleys 149 and 150 while the tail shaft is provided with non-magnetic belt pulleys 151 and 152. Laterally spaced parallel belts 153 and 154 are trained about the pulleys 151 and 149, and 152 and 150, respectively. Jack screws 155, four in number, extend between the frame and tail shaft at the journals to provide the proper belt tension. The side plates are provided with hangers supports 156, two on each plate, each hanger support having a vertically extending tapped aperture 157 therein so that the conveyor may be supported from the overhead frame in turn supported by the inverted U-shaped frames 41 and 43 seen in FIG. 1.

Extending between the side plates 144 and 145 are two transverse magnet rail supports 158 and 159 which in turn support longitudinally extending magnet rails 160, there being two such rails immediately overlying the subjacent lower flight of the belts. Such rails in turn support permanent magnets 161, there being three such permanent magnets for each belt. Secured to the head cross bar 146 is a bracket 163 supporting the transmitter head 164 of the double sheet detector 15 seen in FIG. 1. The receiver of the double sheet detector is mounted on a bracket immediately below the underside of the liftoff conveyor and both the transmitter and receiver are adjustable accurately to control the gap therebetween.

As seen in FIG. 6, the liftoff conveyor is constructed to provide a vertical opening 165 to permit the positioning and vertical movements of the stack pickoff 13. The belts of this conveyor may be of a non-stretchable PVC material, being the same as the drive belt 65 for the infeed conveyor as well as the belt 93 for the outfeed conveyor 19.

Figure 7:
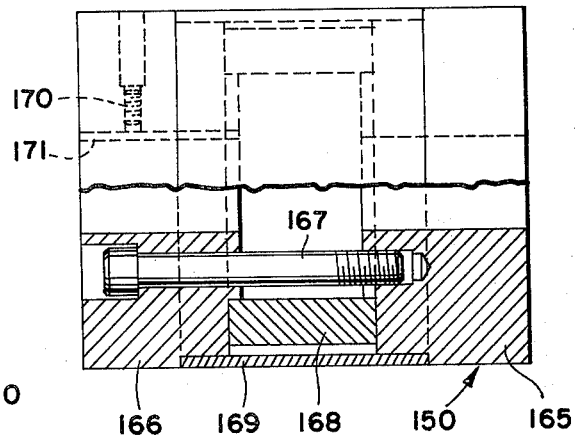
FIG. 7 is an enlarged view partially broken away and in section of one of the magnetic pulleys at the exit end of such conveyor.
Figure 5:
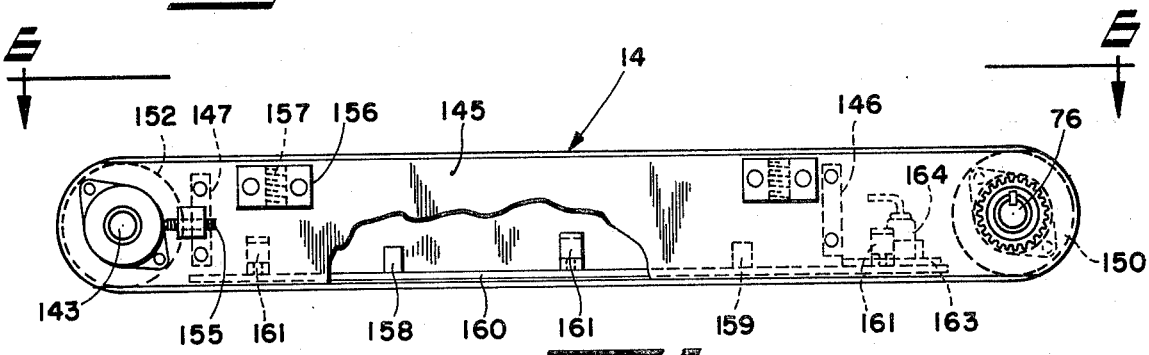

In addition to the three permanent magnets for each of the belts, the tail shaft pulleys 149 and 150 also incorporate a permanent magnet as seen in detail in FIG. 7. Each magnetic pulley includes a right hand end section 165 and a left hand end section 166 held together by two elongated socket head cap screws 167. The right and left hand end sections are shouldered to receive annular permanent magnet 168 and ring 169, the latter forming a continuum of the cylindrical surface of the end sections 165 and 166. A set screw 170 is provided for securing a key in keyway 171, in turn to secure the pulley to the tail shaft 76.

Accordingly, magnetic pulleys need only be provided on the tail shaft since the blanks will be elevated by the liftoff against the underside of the conveyor and held thereby to move to the right as seen in FIGS. 1, 5 and 6.

SECONDARY ELEVATOR — FIGS. 8 & 9

Figure 8:
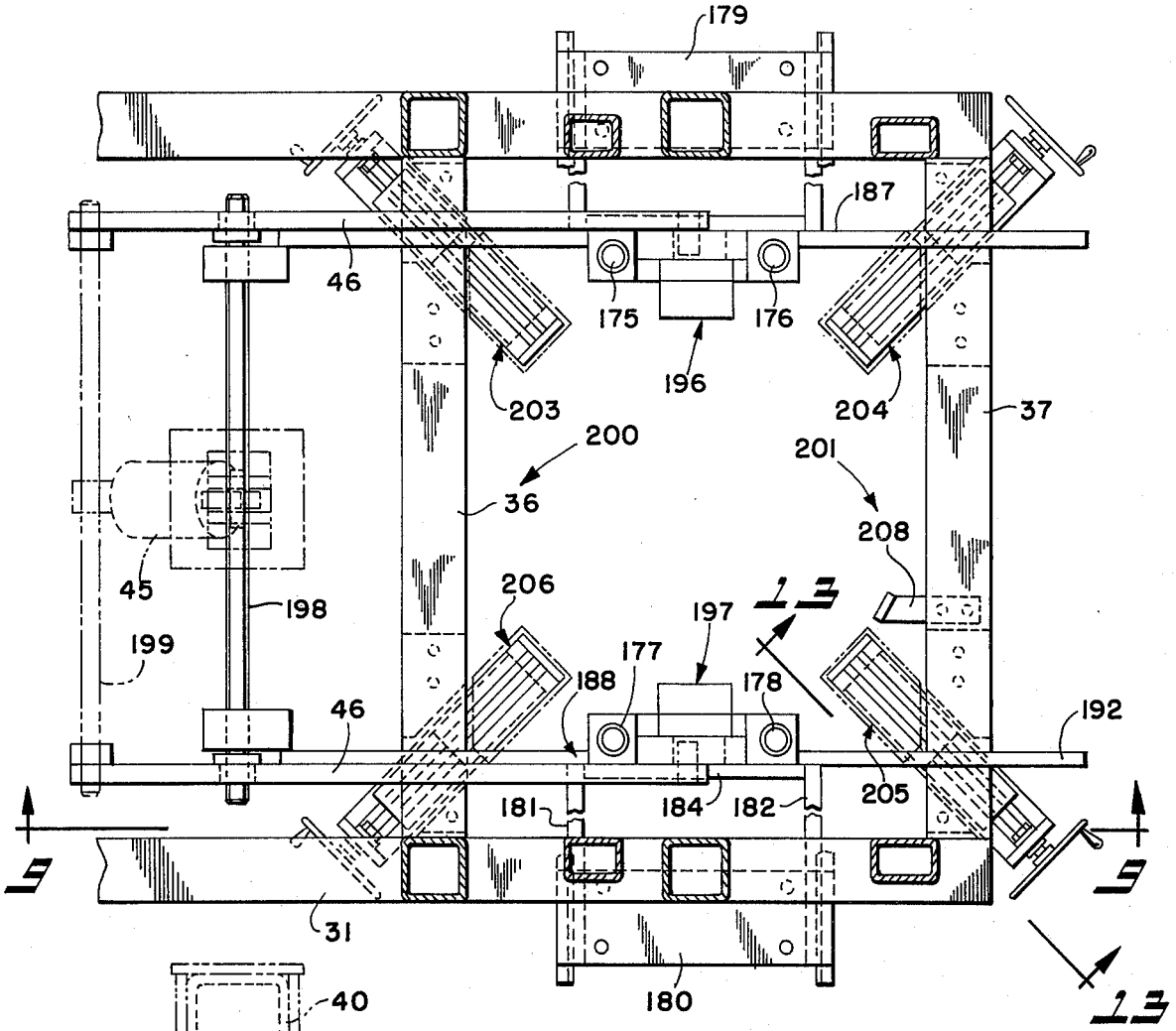
FIG. 8 is an enlarged fragmentary horizontal section through the secondary lift and illustrating the position of the fanner magnets.
Figure 9:
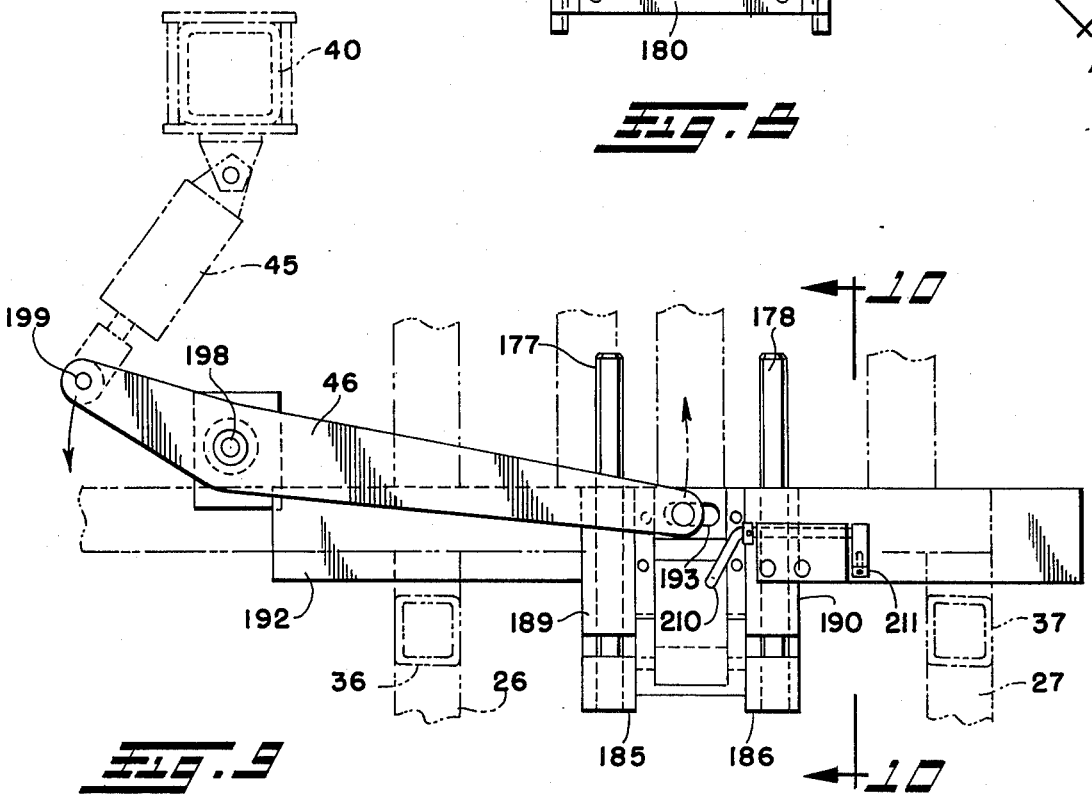
FIG. 9 is a fragmentary elevation of the secondary lift taken from line 9—9 of FIG. 8.

The secondary elevator as seen in FIGS. 8 and 9 is guided for vertical movement by four relatively short vertically extending guide rods 175, 176, 177 and 178. The guide rods 175 and 176 are mounted on a bracket 179 while the guide rods 177 and 178 are mounted on bracket 180. Each bracket includes inwardly projecting arms as indicated at 181 and 182 which are adjustable in length so that the guide rods supported thereby may be moved toward and away from the center of the machine indicated at 183. The movable portion of the bracket includes a vertically extending U-shape plate 184, the lower ends of which are provided with bosses 185 and 186, in which are secured the lower ends of the guide rods, as by set screws, for example. Vertically movable on the paired guide rods are hook frames 187 and 188, one on each side of the machine.

Each hook frame includes a vertically elongated boss surrounding the respective guide rod as indicated at 189 and 190 and bushings may be provided therein to facilitate the vertical movement of the frame along the guide rods. Such hook frames also include horizontally elongated side rails 192. The back of top center of each hook frame includes a horizontally elongated slot 193 in which the inwardly projecting pin 194 on the inner end of each lever 46 is confined.

Stack lifting hook assemblies are pivotally supported by each hook frame as indicated at 196 and 197. Vertical movement of the hook frames, is, of course, obtained by pivoting the levers 46 about the fixed pivot shaft 198 by extension and retraction of the piston-cylinder assembly 45, the rod of which is connected to transverse shaft 199 interconnecting such levers at their outer ends. Accordingly, extension of the piston-cylinder assembly 45 will move the ends of the levers 46 in the direction of the arrow 200 elevating the hook frames 187 and 188, as a unit. Adjustment of the hooks 196 and 197 toward and away from the center of the machine may readily be obtained by the adjustment of the arms of the bracket and the repositioning of the levers on the pivot shaft 198 and interconnecting shaft 199.

The elongated side rails of each hook frame may be interconnected to support additional stack supporting hooks other than the two illustrated. Depending upon the type, configuration, and size of blank, additional supporting hooks may be required for the secondary lift and these can be provided in the areas 200 and 201. Such additional stack supporting hooks would, of course, be adjustable longitudinally of the side rails again to be movable toward and away from the center 183 of the machine. Accordingly, substantially any configuration, type or size of blank may be supported by the secondary lift.

Figure 13:
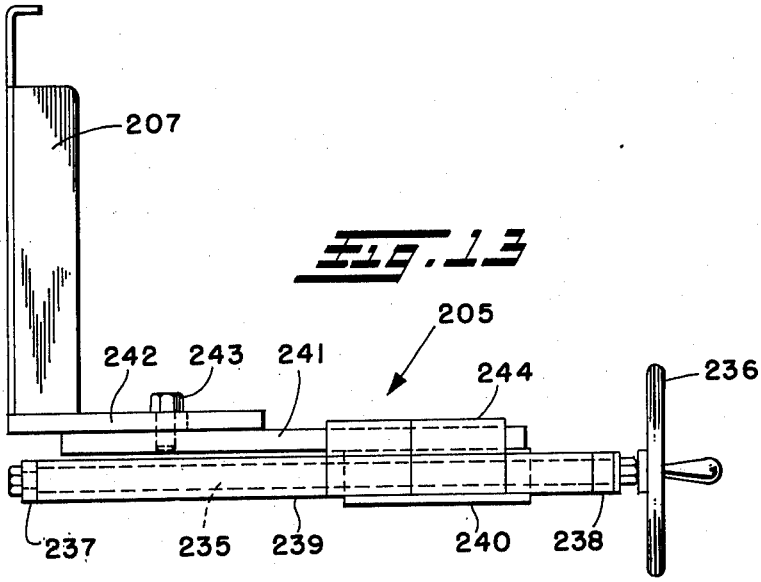
FIG. 13 is an enlarged side elevation of the adjustable fanner magnet support as seen from line 13—13 of FIG. 8.

FIG. 8 also perhaps best illustrates the position of the four adjustable mounting brackets 203, 204, 205 and 206 for the vertically extending fanner magnets 207. Such brackets are mounted on the underside of the horizontal frame members 36 and 37. Each of such brackets is radially adjustable by the hand wheel operated screws so that the fanner magnets may be positioned in the desired location toward or away from the center of the machine. The details of the fanner magnet brackets are shown in FIG. 13. Also mounted on the frame member 37 is bracket 208 for supporting the stack height sensor which alternately controls the feed stroke of the primary and secondary elevators.

Each of the hooks 196 and 197 is provided with a limit switch sensing the position thereof signaling that the hook is in or that the hook is not in. In the embodiment of FIG. 9, the limit switch is actuated by arm 210 which may engage against the back of the hook moving switch acutator arm 211 in response to movements of the hook. A spring holds the arm 210 against the back of the hook. When the hook is in in stack engaging position, the switches will signal the elevation of the stack supported thereby to be controlled by the stack height sensor on bracket 208.

LIFT LATCH AND HOOK, FIRST EMBODIMENT — FIGS. 10–12

Figure 10:
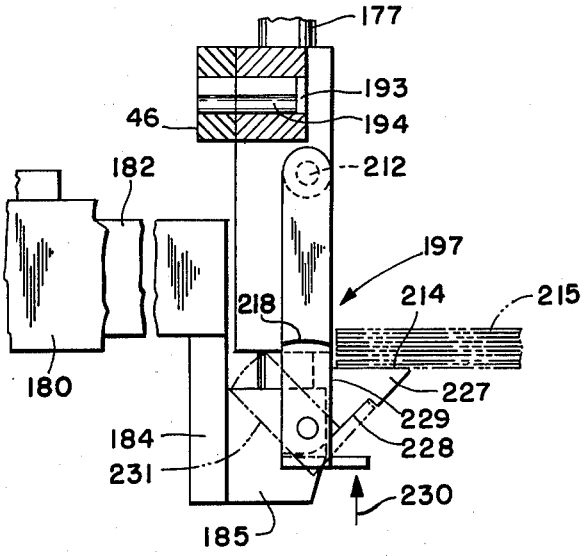
FIG. 10 is a fragmentary elevation of one embodiment of the hook and latch of the secondary elevator taken substantially from line 10—10 of FIG. 9.
Figure 11:
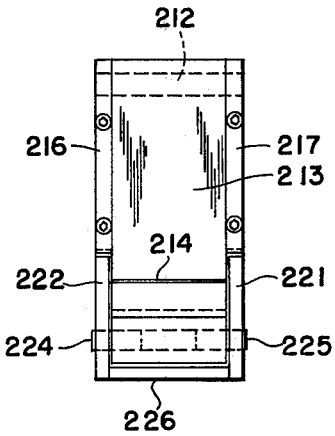
FIG. 11 is an elevation of the hook and latch as seen from the right in FIG. 10.
Figure 12:
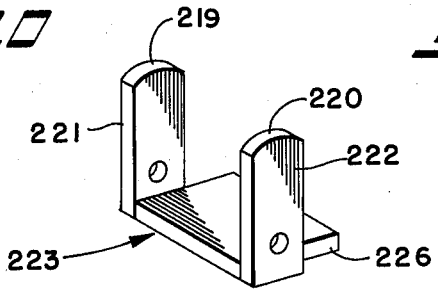
FIG. 12 is an enlarged isometric view of the pivotally mounted latch release.

The embodiment of the lift latch and hook shown in FIGS. 8 and 9 is shown in more detail in FIGS. 10 through 12.

The hook 197 is pivoted at 212 on a dowel pin between the bosses 189 and 190 of the hook frame. The hook includes the main vertically extending body 213 and the inwardly projecting shelf 214 adapted to support a stack of blanks as indicated at 215.

On each side of the hook secured to shoulders on the bosses 189 and 190 are fixed stop plates 216 and 217 which have arcuate bottom edges seen at 218 in FIG. 10. Such arcuate edges closely cooperate with the top arcuate edges 219 and 220 on the upstanding legs 221 and 222 of latch 223. Such latch is pivotally mounted on dowel pins 224 and 225 to the bottom end of the hook 197. The legs 221 and 222 of the latch 223 are interconnected by flat plate 226. The bottom of the projecting portion of the hook indicated at 227 which forms the projecting shelf 214 is provided with a recess 228 and the sides with stop shoulders 229 which limit the pivotal movement of the latch in both directions. When the hook 197 is hanging straight down from its pivot 212, the legs of the latch extend straight upwardly with the top arcuate surfaces thereof nesting within the arcuate surfaces 218 of the fixed side plates 216 and 217. In such position the hook cannot pivot rearwardly about the pivot 212. When a substantial pressure is exerted on the latch plate 226 as indicated at the arrow 230, the latch is caused to pivot to the phantom line position 231 with the plate 226 nesting in the recess 228 to form a continuous inclined cam surface on the lower side of the projecting portion 227 of the hook. Only when the latch is pivoted to the phantom line position as seen in FIG. 10, with the arcuate surfaces of the latch legs clearing the arcuate surfaces 218 of the fixed side plates, is the hook then free to pivot outwardly about the pivot 212 as seen in FIG. 10. The pivoting of the hook is then obtained by the continuing upward pressure in the direction of the arrow 230 on the inclined cam surface of the hook formed by the plate 226 and the inclined surface of the projection 227. The latch maintains the hook in stack engaging position when there is no or insufficient pressure beneath the hook and permits the hook to withdraw or retract outwardly only when a significant pressure is exerted upwardly on the hook, first to release the latch, and then to cam the hook outwardly. Such pressure is obtained by the stack on the primary elevator being moved upwardly against the latch and cam surfaces of the hook.

FANNER MAGNET SUPPORT — FIG. 13

The fanner magnets 207 are vertically oriented permanent magents positioned adjacent the edge of the stack to impart an opposite polarity to adjacent blanks in the stack. This causes the blanks vertically to separate so that they may be lifted from the stack by the vacuum liftoff 13. If non-magnetic blanks are employed, vertical separation may be obtained by other means such as air jets.

To support the fanner magnets 207 there is provided adjustable brackets 203 through 206, each comprising a horizontally extending adjusting screw 235 which may be rotated by hand wheel 236. Each adjusting screw is journalled in end plates 237 and 238 which are interconnected by side rails 239. A guide block 240 is threadedly connected to the adjustment screw and has secured thereto a forwardly projecting arm 241 to which the fanner magnet bracket 242 is adjustably secured by fastener 243. The side rails are interconnected through a U-shape mounting pad 244 so that the entire fanner magnet bracket can be secured to the underside of the frame. In any event, rotation of the adjustment screw by the hand wheel 236 will cause the guide block and slide to move along the screw so that the position of the fanner magnet 207 can readily be controlled and positioned at the proper location adjacent the side of the upwardly moving stack to separate the blanks therein.

VACUUM LIFTOFF — FIG. 14

Figure 14:
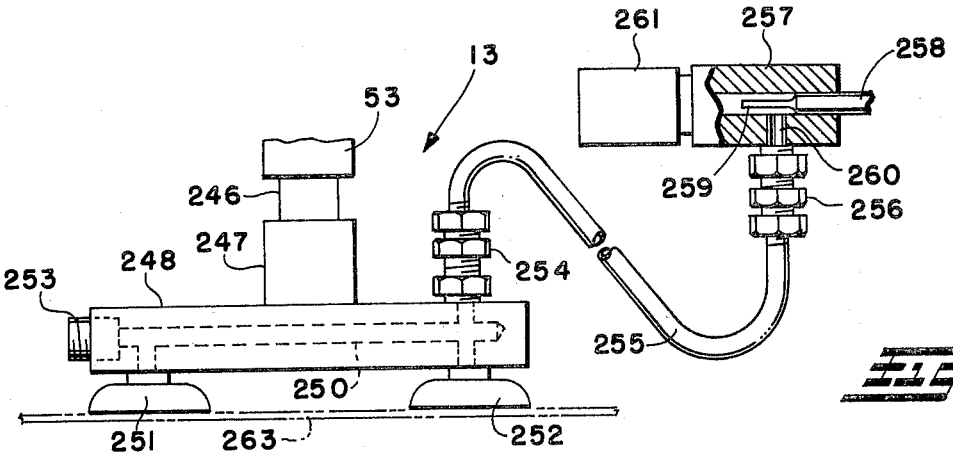
FIG. 14 is an enlarged fragmentary elevation partially in section illustrating the vacuum liftoff.

The vacuum liftoff as seen in more detail in FIG. 14 is vertically moved by the piston-cylinder assembly 53, the rod 246 of which is threadedly connected to boss 247 on manifold block 248. The manifold block includes a horizontal passage 250 in communication with vacuum cups 251 and 252. Such horizontal passage is plugged at one end as indicated at 253 and connected by union 254 to flexible vacuum hose 255. Such hose is also connected by union 256 to venturi block 257. Such venturi block includes an air line 258 having a reduced venturi pipe 259 adjacent the lateral opening 260. A muffler 261 is connected to the exhaust. Accordingly, when air moves through the passage 258 and exhausts at high speed from the venturi pipe 259, a vacuum will be created in passage 260, and, of course, in the suction cups 251 and 252. The vacuum will be released by closing the line 258 by a limit switch, hereinafter described when the liftoff is at an elevation such that the blank supported thereby at 263 is brought closely adjacent the underside of the liftoff conveyor 14 to be held by the magnets thereof. The vacuum liftoff will, of course, be elevated so that the suction cups 251 and 252 are above the bottom plane of the liftoff conveyor 14. When the blank is then laterally clear of the liftoff, it will descend on signal to pick up another blank from the top of the stack.

DOUBLE BLANK EJECTOR — FIG. 15

Figure 15:
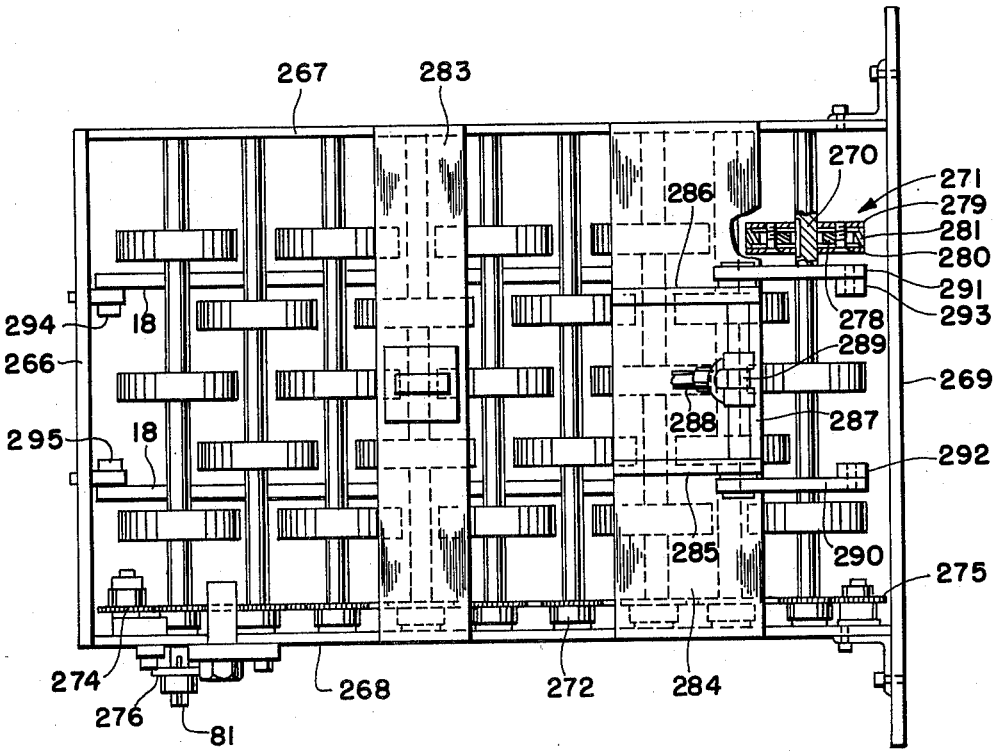
FIG. 15 is an enlarged top plan view, partially broken away and in section, of the double blank ejector.

Referring now to FIG. 15 in addition to FIG. 1, it will be seen that the double thickness or blank ejector 17 is mounted on the magnetic roller conveyor 18 and is operated by pneumatic piston-cylinder assembly 265 which is actuated from the double thickness detector 15. The magnetic roller conveyor 16 includes a front plate 266, two side plates 267 and 268, and a back plate 269. A series of roller shafts 270 extend between the side plates and each shaft has either two or three magnetic rollers 271 keyed thereto for rotation therewith. As illustrated in FIG. 15, alternate shafts have three and two rollers thereon, respectively, so that the rollers interfit in the manner shown. The rollers may be held in the proper position by cylindrical spacers surrounding the shafts. Each shaft is provided with a drive sprocket seen at 272. An elongated bar 273 is provided on the side plate 268 immediately subjacent the sprockets 272 to hold the chain drive thereof against the sprocket teeth. Such chain drive also passes around two idler sprockets 274 and 275 slightly elevated from the roller shaft drive sprockets to maintain the chain drive clear of the roller drive sprockets on the return flight. All of the rollers are thus rotated uniformly in a counterclockwise direction as viewed in FIG. 1 by the chain drive 82 engaging sprocket 276 on the projecting end of the shaft 81.

Each magnetic roller 271 includes a magnetic core 278 sandwiched between hardened steel side plates 279 and 280 with the periphery of the roller being an aluminum or non-magnetic ring 281. The roller assembly may be held together by the fasteners indicated at 282. The core 278 of the rollers is preferably magnetized after the roller is assembled.

The blind end of the piston-cylinder assembly 265 is mounted on a transverse top plate 283 while another top plate 284 has secured thereto upstanding ears 285 and 286 between which extends pivot shaft 287. The rod 288 of the piston-cylinder assembly 265 is clevis connected to a relatively short arm projecting upwardly from the shaft 287 and secured thereto as seen at 289. Also secured to each end of the shaft 287 are two arms 290 and 291 which are pinned to downwardly extending links 292 and 293, respectively. As perhaps best seen in FIG. 1, such downwardly extending links are pin connected to the ends of ejector bars 18, the opposite ends of which are pivoted at 294 and 295 to the frame plate 266. The ejector bars 18 are preferably made of stainless steel or other suitable hard non-magnetic material.

Accordingly, when the double thickness detector 15 detects a blank of more than normal thickness, piston-cylinder assembly 265 will be extended upon suitable short interval delay, pivoting the shaft 287 in a clockwise direction as seen in FIG. 1 causing the ejector bars 18 to descend stripping the double thickness part from the bottom of the ejector conveyor 16. such double thickness parts may then fall into a suitable reject container. As soon as the ejector bars have extended, the pistoncylinder assembly 265 will be immediately reversed causing the bars 18 to move to a horizontal position above the plane of the bottom of the rollers 271. The bars 18 will remain in that position until again extended by the double thickness detector. Parts not thus ejected will pass along the bottom of the conveyor 16 and through the rolls 85 and 86 onto the top of the outfeed conveyor 19. The outfeed conveyor, like the liftoff conveyor, is provided with bar magnets so that the parts being dealt or conveyed one-at-a-time from the stack are under constant control of the machine.

LIFT HOOK AND LATCH, SECOND EMBODIMENT — FIGS. 16-18

Figure 16:
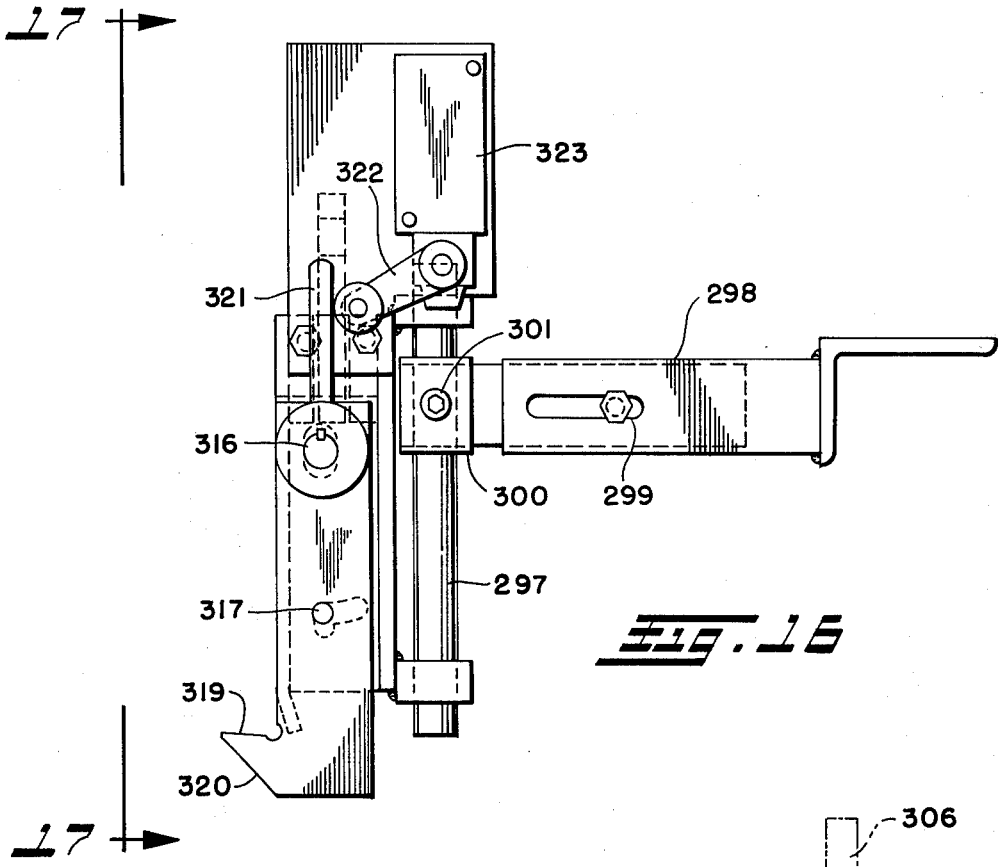
FIG. 16 is a slightly enlarged side elevation of another embodiment of a hook and latch for the secondary elevator.
Figure 17:
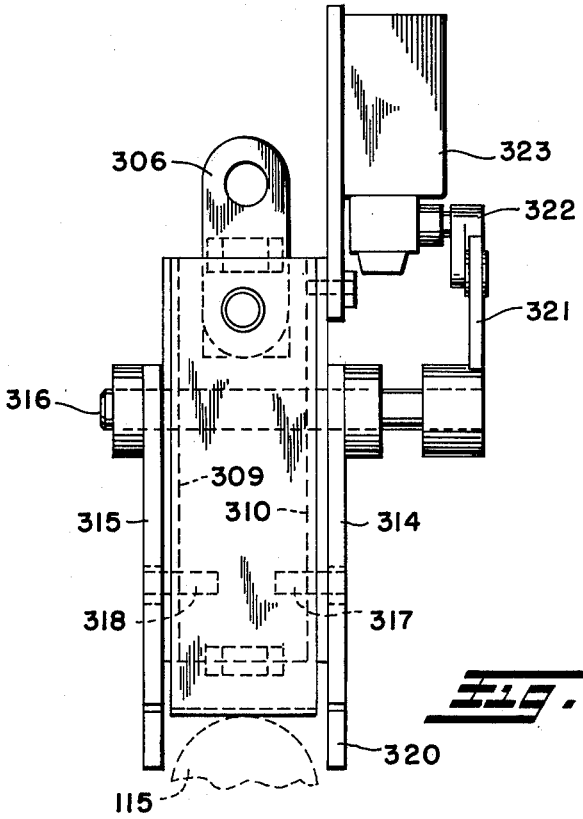
FIG. 17 is an elevation of the hook and latch of FIG. 16 seen from line 17—17 thereof.
Figure 18:
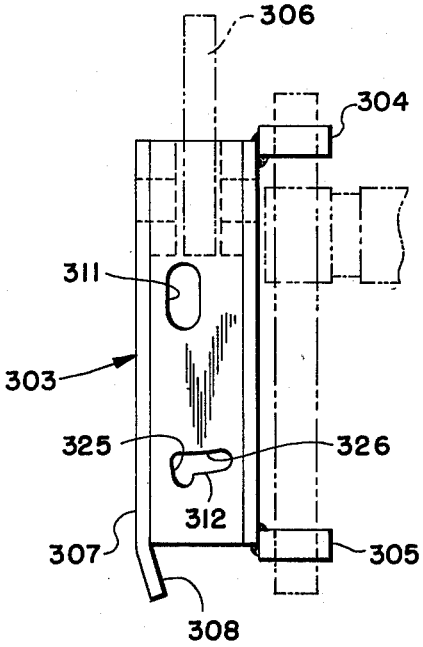
FIG. 18 is a view similar to FIG. 16 but with the pivoting hook removed more clearly to illustrate the slots by which release of the hook is obtained.
Figure 21:
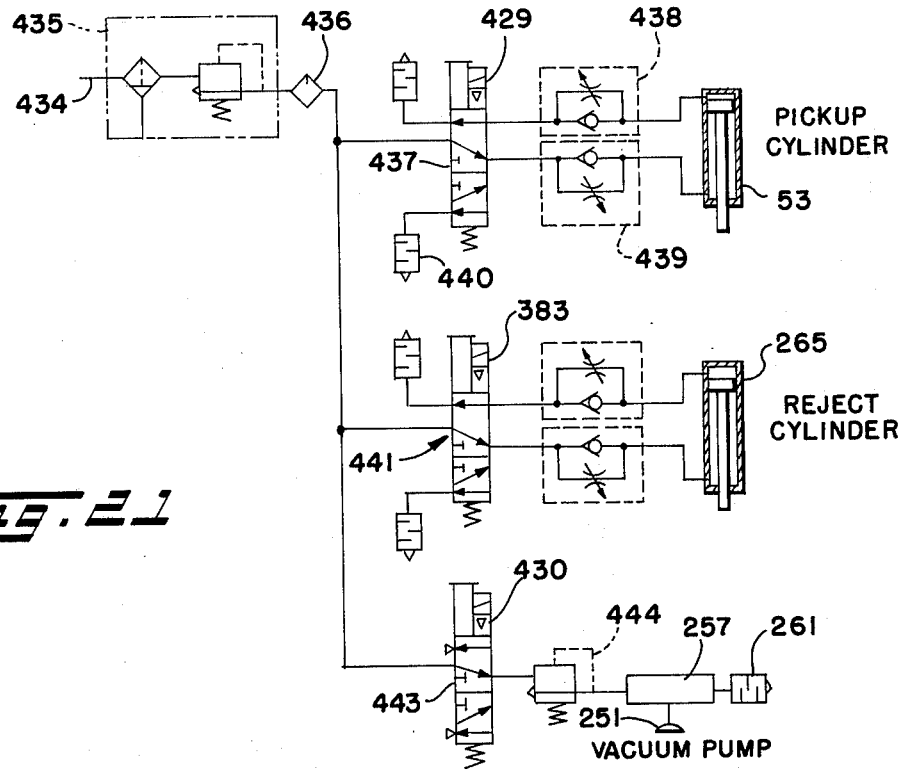
FIG. 21 is a schematic pneumatic diagram showing the components operated pneumatically.
Figure 22:
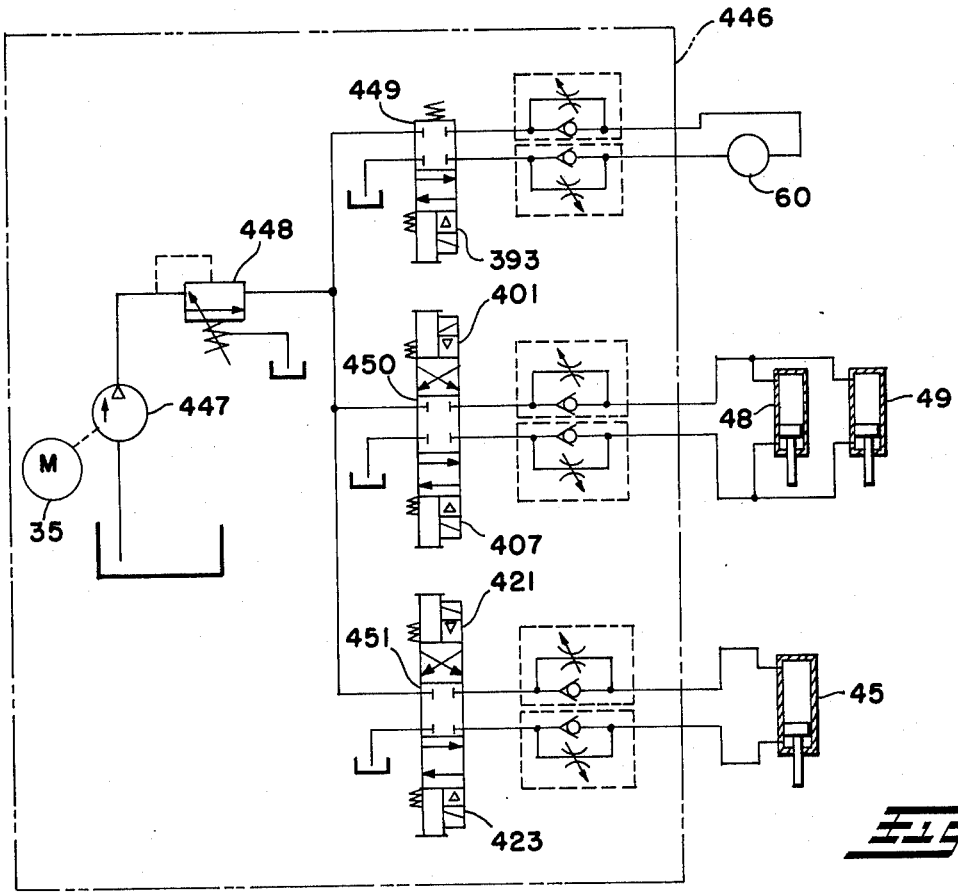
FIG. 22 is a schematic hydraulic diagram showing the components operated hydraulically.

Another embodiment of the secondary lift hook and latch assemblies is shown in FIGS. 16 through 18, and like the embodiment shown in FIGS. 10 through 12, the hook and latch assemblies are mounted for vertical movement along guide rods 297 which are supported from brackets 298 which may be extended by the adjustment 299 toward and away from the center of the machine. The guide rods may be secured in the bracket bosses 300 by the set screws 301.

Each hook assembly includes a fabricated box-like vertically extending frame 303. The back of each frame is provided with two vertically spaced bosses 304 and 305 through which the vertically extending guide rod 297 passes. The top of the frame has pinned thereto a link 306, the upper aperture in which engages the inwardly projecting pins 194 of the lift levers 46 seen for example in FIGS. 8 and 9. The front of the frame includes a plate 307, the lower end of which is inclined rearwardly as indicated at 308 to provide a stack pilot. The side plates 309 and 310 of the frame are each provided with horizontally aligned vertically elongated slots 311 and horizontally aligned bayonet type slots 312.

Right and left hand hooks 314 and 315 are keyed to shaft 316 which projects through the vertically elongated slots 311 in the side plates of the frame. Each hook includes an inwardly projecting pin as seen at 317 and 318 which fits within the respective bayonet slots 312 in the side plates of the frame. As seen in FIG. 16, each hook includes an inwardly projecting stack supporting shelf 319 and an inclined cam surface 320. The lower ends of the hook project substantially beneath the lower edge of the frame. The hook pivot shaft 316 has mounted thereon a switch operator 321 engaging spring loaded switch arm 322 of switch 323. The two position limit switch will signal either that the hook is in or that the hook is not in controlling the elevation of the stack either through the primary or secondary lift, from the stack height sensor.

As seen in FIG. 18, the bayonet slot 312 includes a short vertically extending portion 325 and an arcuately horizontally extending portion 326. Upward pressure on the cam surfaces 320 by the edge of a stack being elevated by the primary elevator must then first provide sufficient pressure to lift the hooks to clear the pins 317 and 318 before they will begin to pivot rearwardly. Without such significant upward pressure, the hooks will remain locked in their in position.

The hooks of the embodiment of FIGS. 16 through 18 are preferably used in the handling of stacks without pallets. Thus the right and left hand hooks are sufficiently laterally spaced to permit the center roll 115 of the primary elevator to nest therebetween. With the first embodiment of FIGS. 10 through 12, special pallets are required to permit the hooks to engage beneath the incoming stacks. With this embodiment, however, such pallets are not required. In either embodiment, the hooks are latched in the in position and cannot be unlatched without significant upward pressure. In both embodiments, after such significant upward pressure is obtained, the hooks will be cammed out of engagement tripping the associated limit switch.

SCHEMATICS — FLOW DIAGRAM — FIG. 19

A stack of parts or blanks indicated at 330 in FIG. 19 is positioned on a specially designed pallet 331 and placed on the infeed conveyor 10 which may be provided with centering guides to ensure the proper position of the stack transversely of the conveyor. Conversely, the centering may be provided on an upstream conveyor feeding the infeed conveyor 10. When the infeed conveyor is not in operation, the stack 330 will simply stop thereon. When the infeed conveyor 10 is energized, the stack 330 will move to the right as seen in FIG. 19 to be positioned on the rolls 114, 115 and 116 of the primary elevator 11. The infeed conveyor will be stopped when the sensor 140 seen in FIG. 4 is tripped. The infeed conveyor will not be energized until the primary elevator is down and empty. When the stack is in the position 332, the previous stack is supported directly thereabove by the lifting hooks of the secondary elevator 12 as indicated at 333. With the hooks of the secondary elevator in engagement, as shown in FIG. 19, the control of the upwardly moving stack into the fanner magnets 207 is by the piston-cylinder assembly 45.

With the lower stack in position 332, the primary elevator will then be elevated until the top 334 of the stack engages the secondary lift hooks, first unlatching the same, and then camming the same outwardly. This merges the stacks 332 and 333 and shifts the control of the upward movement of the stack into the fanner magnets to the primary elevator piston-cylinder assemblies 48 and 49. When the hooks of the secondary lift are out, the secondary elevator descends to its lowermost position. Control of the merged stacks continues with the stack height sensor controlling the primary elevator. When the bottom 335 of the stack is above the shelves or inwardly projecting portions of the secondary elevator hooks, the hooks will swing into position beneath the stack and latch themselves in place. When the limit switches associated with the hooks signal that the hooks are in, control of the stack is then transferred to the secondary elevator and the primary elevator descends with the pallet 331 thereon. When the primary elevator is at its lowermost position, energization of the infeed conveyor 10 will cause the pallet to move to the right as shown by the arrow 336 dropping into a bin or onto a pallet return. A new stack will then be positioned on the primary elevator by the infeed conveyor to be elevated again to merge with the stack held by the secondary elevator.

While the primary and secondary elevators are thus forming a continuously upwardly moving stack by merging the stack increments being fed thereto, the liftoff is picking up the separated blanks as indicated at 337 placing them on the underside of the liftoff conveyor 14. Such conveyor, together with the ejector conveyor 16 and the outfeed conveyor 19, horizontally feed the parts one-at-a-time from the top of the stack in the direction of the arrow 338, the double sheet detector and ejector ensuring that only one part at a time leaves the feeder.

If stacks without pallets 331 are employed, then hooks such as shown in FIGS. 16 through 18 will be employed.

ELECTRICAL SCHEMATIC — FIG. 20

The hydraulic pump drive motor 35 is controlled by three normally open contacts 340, one in each of the lines of the three-phase system for the motor. Such lines also provide the power to a transformer 341 providing lower voltage single-phase power to the control lines 342 and 343 for the various relays and controls of the circuit. Not all of the controls will be described in detail, but only those sufficient to understand the operation of the machine. The machine may be operated in automatic or manual mode by selector switch 344 controlling either automatic relay 345 or manual relay 346. The lights in parallel with the relays indicate the mode. A stop button 347 and a start button 348 are provided, the latter when closed energizing the hydraulic drive relay 349 controlling switches 340. An optional feature disclosed in FIG. 20 is a motor relay 350 which may also be energized with the hydraulic drive motor 35, such motor being employed to drive an oil pump arranged, for example, to lubricate the parts passing between the ejector conveyor and the outfeed conveyor. If the blanks are being fed to a drawing or other similar operation, such blank lubrication would then be required. Normally continually energized in a photoelectric relay 351, which as previously indicated, may be utilized in lieu of physical contact stack position sensor 140 seen in FIG. 4.

The automatic relay 345, in addition to a variety of other contacts, closes contact 352 in left hand line 342 while the manual relay 346 normally closes contact 353 in line 354 which is parallel to the line 342. As indicated, the line 354 is connected to the various relays by manually operable push buttons so that the functions obtained by such relays can be controlled manually. The automatic mode relay will close contacts 355 through 359 permitting energization of the conveyor relay 360, lower lift relay 361, lower second lift relay 362, extend pickup relay 363, and hooks retracted relay 364, respectively. The automatic and manual relays also function to close parallel contacts 365 and 366 controlling stack in position relay 367. Accordingly, the stack in position relay will function in either mode of the circuit. The same is true of contacts 369 and 370 controlled by the automatic and manual mode relays, respectively, both providing a holding circuit around the start button 348.

In addition to the relays already indicated, there is also provided a raise lift relay 372 for the primary elevator, a logic relay 373, a raise secondary lift relay 374, a safety relay 375, and a lift retracted relay 376 at the very bottom of the figure. The relays thus described are conventional control relays. In addition, there is provided a time delay relay 378 and proximity relays 379 and 380. The time delay relay 378 is controlled by contacts 381 operated by proximity relay 380 and in turn functions to close contact 382 on delay energizing reject part solenoid 383. The proximity relay 380 is in turn triggered by the double thickness detector 15 which includes the vertically adjustable transmitter 164 and the receiver 385. The presence of a metal part between the transmitter and receiver of undue thickness induces a change in frequency of an oscillating coil and an adjustable output is produced triggering the relay.

The proximity relay 379 is controlled by stack height sensor 386 which is mounted on bracket 208 seen in FIG. 8. Such proximity relay 379 functions to control the feed strokes of the primary and secondary lifts through contacts 387 and 388. Normally the proximity device 386 will sense the amount of metal at the top of the stack and will supply an intermittent signal through the relay 379 causing the piston-cylinder assemblies controlled by the control relays 372 and 374, respectively, to inch upwardly the respective elevators moving the blanks into the fanner magnets.

When the primary lift is fully retracted, limit switch contacts 390 will close energizing lift retracted control relay 376 seen at the bottom of FIG. 20 which in turn closes contacts 391 to energize conveyor control relay 360 in the automatic mode of operation. This in turn closes switch contacts 392 in series with conveyor drive solenoid 393. A stack of blanks is then moved along the infeed conveyor until relay 367 is de-energized by the opening of either limit switch or photoelectric switch contact 394. This in turn opens contact 395 to stop the conveyor. Control relay 367 also closes normally open contacts 396. With the hooks in and beneath the stack in the secondary lift, limit switches 323 will be closed energizing relay 364 to close contacts 397 bypassing the contacts 387 thus energizing the control relay 372 through the normally closed contacts 398 and 399. Control relay 372 then closes contacts 400 energizing solenoid 401 retracting the piston-cylinder assemblies 48 and 49 to elevate the primary elevator.

The elevation of the primary elevator brings the stack thereon into contact with the hooks of the secondary elevator unlatching the same and causing them to pivot to a retracted position. This trips the limit switches 323 opening contacts 397 so that the primary elevator is now under the control of switch contacts 387 and continues to inch upwardly as directed by the proximity device 386. The contacts 398 and 399 are opened by the control relays 361 and 360, respectively, so that the control relay 372 cannot be energized during the operation of the conveyor or the lowering of the primary elevator. Conversely, the control relay 372, when energized, opens contacts 402.

When the primary elevator has achieved its extended or upper limit position, two contact limit switch 403 will be tripped and will energize control relay 361 if contacts 404 have been closed by the control relay 364 signalling that the hooks of the secondary lift have achieved the proper stack supporting position. The primary lift then descends to its lowermost position. Control relay 361 closes contacts 406 in series with solenoid 407 to lower the primary elevator.

When the primary lift descends through energization of the control relay 361, contacts 408 are also closed energizing relay 373 which in turn closes holding contacts 409 and contacts 410. With the latter contacts closed, the control relay 374 controlling the elevation of the secondary lift is then controlled by contacts 388 in turn controlled by the proximity relay 379.

The secondary lift continues upwardly at the direction of the stack height sensor proximity device until one of two things happen. If the secondary lift reaches its upper limit, limit switch 412 is tripped opening contacts 413 to de-energize relay 474. The limit switch also closes contacts 414 energizing safety relay 375 which will then in turn open contacts 415 in the press circuit to stop the press or whatever device is being fed by the machine as indicated at the bottom in FIG. 20. Also, as indicated, a light will come on indicating that no blanks are being fed by the machine.

However, in the normal continuity of the machine, the primary elevator has returned for another stack increment and has again elevated to engage the hooks on the secondary lift unlatching the same and camming them outwardly. With the hooks out, contacts 417 are closed by the relay 364 energizing control relay 362 to lower the secondary lift. The secondary lift will continue down until limit switch 418 is opened at its lowermost position. The secondary lift control relay 374 will again be energized as the hooks move into position sending the primary elevator back down. The control relay 362 closes contacts 420 in series with solenoid 421 while the control relay 374 closes contacts 422 in series with solenoid 423.

The control relay 363 for the blank pickup or liftoff is controlled by limit switches 425 and 426, the latter being an adjustable lower limit causing the pickup to retract. The pickup extends at the direction of switch 425 which is preferably cam operated in the cycle of the press. A cam suitable for this purpose is shown at 427 in FIG. 1 on the sprocket shaft of the power takeoff unit 70. In any event, the relay 363 functions when energized to close contacts 428 in series with solenoid 429. Vacuum solenoid 430 is controlled by limit switch 431 which opens momentarily when the pickup is close to the magnetic belt conveyor 14 transferring the picked up blank to such conveyor. The switch closes as the pickup extends to obtain another part.

In describing the above circuit, it will be appreciated that a number of details of the circuit have not been described relating principally to holding circuits, interlocks, and the manual or jogging circuits.

SCHEMATIC — PNEUMATICS, FIG. 21

To operate the pneumatic components of the machine which are the pickup cylinder 53, the reject cylinder 265 and the vacuum, air is supplied from line 434 through filter-regulator unit 435 through line lubricator 436. Two position valve 437 having a spring return is operated by solenoid 429 to supply air pressure through flow controls 438 and 439 to either the blind or rod end of the cylinder 53, depending upon the energization of the solenoid 429. The exhaust openings in the valve for each position are provided with mufflers 440. The pneumatic equipment for the reject cylinder 265 includes a two position valve 441 and is the same as that for the pickup cylinder 53. A two position valve 442 having plugged exhaust openings simply opens and closes air flow to venturi block 257 through pressure regulator 444.

SCHEMATIC — HYDRAULICS, FIG. 22

The portion of the hydraulic circuit enclosed by the phantom line box 446 is provided in the hydraulic power package 34 seen in FIG. 1. The motor 35 drives hydraulic pump 447 through relief valve 448 to control valves 449, 450 and 451. The valve 449 is operated by solenoid 393 controlling hydraulic conveyor motor 60, the speed of which is controlled by the two flow controls indicated at 452.

Valves 450 and 451 are three position valves each operated by the two solenoids shown. In the center position of such valves, flow is blocked. Energization of the solenoid 401 shifts the valve to supply hydraulic fluid to the rod ends of the elevator cylinders 48 and 49 raising such elevator while energization of the solenoid 407 lowers the primary elevator. Again, adjustable flow controls are provided.

Energization of the solenoid 421 lowers the secondary lift by retracting the piston-cylinder assembly 45 while energization of the solenoid 423 extends the piston-cylinder assembly to elevate the secondary elevator. Again, adjustable flow controls are provided in both directions of elevator movement.

It can now be seen that there is provided a method and apparatus for continuously conveying blanks one-at-a-time from a stack with the stack being continuously replenished by the aligned elevators which are alternately controlled by the stack height sensor. The destacker method and apparatus of the present invention finds utility in the feeding of presses, both inclined or straight side presses, furnaces, transfer stations, coating lines, laminating devices, or the conveying and sorting of parts.

With the illustrated embodiment, parts may be fed at a rate of about 20 to about 70 parts per minute depending on the type and size of part.

We, therefore, particularly point out and distinctly claim as our invention:

1. A blank feeder comprising means for forming a continuously vertically moving stack of blanks from stack increments, and means for removing the blanks one-at-a-time from the top of such stack, an infeed conveyor for such stack increments, said first mentioned means comprising vertically aligned primary and secondary elevators at the exit end of said infeed conveyor, stack support means on said secondary elevator operative to disengage the stack supported thereby as the stack increment on the primary elevator moves subjacent the stack supported by the secondary elevator, said stack support means on the secondary elevator comprising a pivotally mounted hook adapted to engage beneath and support a stack of blanks, cam means on said hook operative to pivot said hook outwardly to disengage the stack supported by the secondary elevator, and latch means operative to release said hook for pivoting only on the achievement of significant camming pressure on said cam means.

2. Apparatus for conveying blanks one-at-a-time comprising stack forming means, a liftoff for removing blanks from the top of the stack, and means for conveying the lifted-off blanks laterally from such stack, said stack forming means comprising two vertically aligned elevators, each adapted to support a stack of blanks, stack support means on the upper of said elevators operative to release the stack held thereby when the stack on the lower of said elevators is elevated subjacent the stack of the upper elevator, with the lower elevator then supporting the merged stack of both elevators, said stack support means on the upper elevator engaging beneath the merged stack at a predetermined height of the lower of said elevators to permit the latter to return for another stack, said stack support means comprising a pivotally mounted hook, means responsive to the position of said hook to shift control of the upwardly moving merged stack between said elevators, and latch means to preclude release of said hook until the stack on said lower elevator is subjacent the stack of said upper elevator.

3. A blank feeder comprising an infeed conveyor for horizontally transferring a stack of blanks, a first elevator at the end of said conveyor to receive such stack, and a secondary elevator above and aligned with said first elevator, said secondary elevator including stack support means operative to pass the stack supported by said first elevator therethrough and engage beneath such stack to permit the first elevator to return for another stack, said stack support means comprising a pivotally mounted hook, cam means thereon operative to pivot said hook outwardly as the stack supported by the first elevator moves upwardly thereagainst, and latch means operative to preclude said hook from pivoting outwardly until the stack on the first elevator exerts substantial pressure thereon.

4. A blank feeder comprising means for forming a continuously vertically moving stack of blanks from stack increments, and means for removing the blanks one-at-a-time from the top of such stack, an infeed conveyor for such stack increments, said first mentioned means comprising vertically aligned primary and secondary elevators at the exit end of said infeed conveyor, stack support means on said secondary elevator operative to disengage the stack supported thereby as the stack increment on the primary elevator moves subjacent the stack supported by the secondary elevator, said stack support means on the secondary elevators comprising diametrically opposed pivotally mounted hooks adapted to engage directly beneath and directly support a stack of blanks on said primary elevator, liftoff means for removing the blanks one-at-a-time from the top of such stack, a laterally extending liftoff conveyor adapted to receive such blanks from said liftoff means, a double thickness detector on said liftoff conveyor, and an ejector downstream of said liftoff conveyor operated by said double thickness detector, said ejector comprising a magnetic roller conveyor and a pivotally mounted stripping bar operative to pivot to an ejecting position in response to a signal from the double thickenss detector, said roller conveyor supporting the lifted-off blank on the underside thereof, and the stripping bar in ejecting position extending downwardly therefrom.

5. A blank feeder comprising means for forming a continuously vertically moving stack of blanks from stack increments, and means for removing the blanks one-at-a-time from the top of such stack, an infeed conveyor for such stack increments, said first mentioned means comprising vertically aligned primary and secondary elevators at the exit end of said infeed conveyor, stack support means on said secondary elevator operative to disengage the stack supported thereby as the stack increment on the primary elevator moves subjacent the stack supported by the secondary elevator, said stack support means on the secondary elevator comprising diametrically opposed pivotally mounted hooks adapted to engage directly beneath and directly support a stack of blanks on said primary elevator, and a horizontally movable stack stop positioned on the opposite side of said primary elevator from said infeed conveyor operative to extend to a stack stop position when the said primary elevator is in its lowermost position.

6. A blank feeder as set forth in claim 1 including a stack height sensor, and means responsive to the position of said hook alternately to control said primary and secondary elevators with said stack height sensor.

7. A blank feeder as set forth in claim 1 including fanner magnets at the top of the stack operative vertically to separate the blanks.

8. A blank feeder as set forth in claim 1 including liftoff means for removing the blanks one-at-a-time from the top of such stack.

9. A blank feeder as set forth in claim 8 including a laterally extending liftoff conveyor adapted to receive such blanks from said liftoff means.

10. A blank feeder as set forth in claim 9 including a double thickness detector on said liftoff conveyor, and an ejector downstream of said liftoff conveyor operated by said double thickness detector.

11. A blank feeder as set forth in claim 10 wherein said ejector comprises a magnetic roller conveyor and a pivotally mounted stripping bar operative to pivot to an ejecting position in response to a signal from the double thickness detector.

12. A blank feeder as set forth in claim 11 wherein said liftoff conveyor is magnetic and supports the lifted-off blank on the underside thereof.

13. A blank feeder as set forth in claim 1 wherein said primary elevator includes side-by-side horizontally extending stack support rollers, at least one of said rollers being driven by said infeed conveyor in the lowermost position of said primary elevator.

14. A blank feeder as set forth in claim 13 wherein one of said rollers of said primary elevator is an idler roll, and brake means operative to restrain said idler roll from rotation during vertical movement of said primary elevator.

15. A blank feeder as set forth in claim 14 including means to release said brake means at the lowermost position of said primary elevator.

16. A blank feeder as set forth in claim 13 including stack position sensing means operative to sense the proper position of a stack increment on said primary elevator to de-energize said infeed conveyor.

17. A blank feeder as set forth in claim 1 including variable speed hydraulic drive means for said infeed convyor, and interlock means for said drive means operative to energize said drive means only when the primary elevator is down and empty.

18. A blank feeder as set forth in claim 5 including means to retract said stack stop when said primary elevator moves upwardly.

19. Apparatus as set forth in claim 2 wherein said hook includes a cam surface, and bayonet slot means to preclude release of said hook in the absence of significant vertical pressure on said cam surface.

20. Apparatus as set forth in claim 2 wherein said hook includes a cam surface and a pivotally mounted latch, and means responsive to pivoting of said latch to unlock said hook before pressure on said cam surface will be effective to release said hook.

21. Apparatus as set forth in claim 20 wherein said latch forms part of said cam surface in unlocking position.

22. Apparatus as set forth in claim 20 wherein said latch includes a projecting portion having an outer arcuate surface and an opposed fixed arcuate surface which must be cleared by said first arcuate surface to release said hook.

* * * * *